US010016020B2

(12) United States Patent
Wilken et al.

(10) Patent No.: US 10,016,020 B2
(45) **Date of Patent: *Jul. 10, 2018**

(54) ARTICLE OF FOOTWEAR WITH FOREFOOT SECONDARY STUDS

(71) Applicant: NIKE Inc., Beaverton, OR (US)

(72) Inventors: Doug D. Wilken, Hillsboro, OR (US); Collin K. Eder, Portland, OR (US); John Droege, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 20 days.

This patent is subject to a terminal disclaimer.

(21) Appl. No.: 14/746,892

(22) Filed: Jun. 23, 2015

(65) Prior Publication Data

US 2015/0374072 A1 Dec. 31, 2015

Related U.S. Application Data

(62) Division of application No. 13/228,602, filed on Sep. 9, 2011, now Pat. No. 9,072,333.

(51) Int. Cl.

| | |
|---|---|
| ***A43C 15/02*** | (2006.01) |
| ***A43C 15/16*** | (2006.01) |
| ***A43B 5/02*** | (2006.01) |
| ***A43B 13/26*** | (2006.01) |
| ***A43B 5/00*** | (2006.01) |

(52) U.S. Cl.

CPC ..... *A43C 15/162* (2013.01); *A43B 5/00* (2013.01); *A43B 5/02* (2013.01); *A43B 13/26* (2013.01); *A43C 15/161* (2013.01)

(58) Field of Classification Search

CPC ..... A43C 13/26
USPC ..... 36/59 R, 59 C, 126, 128, 129
See application file for complete search history.

(56) References Cited

U.S. PATENT DOCUMENTS

| | | | | |
|---|---|---|---|---|
| 2,095,095 A | | 10/1937 | Howard | |
| 2,179,942 A | | 11/1939 | Lyne | |
| 2,433,303 A | * | 12/1947 | Spini | A43B 13/223 36/59 C |

(Continued)

FOREIGN PATENT DOCUMENTS

| | | |
|---|---|---|
| CN | 101827539 A | 9/2010 |
| CN | 104023578 A | 9/2014 |

(Continued)

OTHER PUBLICATIONS

Response to Office Action as filed Jul. 26, 2016 for Chinese Patent Application No. 2012800532534 and the English translation thereof.

(Continued)

*Primary Examiner* — Ted Kavanaugh
(74) *Attorney, Agent, or Firm* — Honigman Miller Schwartz and Cohn LLP; Matthew H. Szalach; Jonathan P. O'Brien

(57) ABSTRACT

An article of footwear that provides friction between the playing surface and the player's foot is disclosed. In some embodiments, the article footwear includes a sole may have a plurality of wedge-shaped studs in the forefoot region that extend beyond the perimeter of the sole. The article can also include a plurality of elongated studs on a bottom surface region of the sole. The wedge-shaped studs help provide leverage for removing the elongated studs from the ground during cutting.

14 Claims, 11 Drawing Sheets

(56) References Cited

U.S. PATENT DOCUMENTS

| | | | | |
|---|---|---|---|---|
| 4,067,123 | A | | 1/1978 | Minihane |
| 4,194,310 | A | | 3/1980 | Bowerman |
| 4,335,529 | A | | 6/1982 | Badalamenti |
| 4,402,145 | A | | 9/1983 | Dassler |
| 4,641,438 | A | | 2/1987 | Laird et al. |
| 4,642,917 | A | | 2/1987 | Ungar |
| D387,892 | S | * | 12/1997 | Briant ..... D2/962 |
| 6,018,893 | A | | 2/2000 | Workman |
| D559,512 | S | * | 1/2008 | McClaskie ..... D2/954 |
| D572,447 | S | | 7/2008 | Schoenborn et al. |
| D616,635 | S | * | 6/2010 | Coleman ..... D2/902 |
| 7,870,682 | B2 | * | 1/2011 | Meschter ..... A43B 7/14 36/45 |
| 9,072,333 | B2 | | 7/2015 | Droege et al. |
| 2007/0079530 | A1 | | 4/2007 | Fusco |
| 2008/0010860 | A1 | | 1/2008 | Gyr |
| 2008/0072458 | A1 | | 3/2008 | Conneally |
| 2008/0098624 | A1 | | 5/2008 | Goldman |
| 2009/0100716 | A1 | | 4/2009 | Gerber |

FOREIGN PATENT DOCUMENTS

| | | | |
|---|---|---|---|
| DE | 8511418 | U1 | 5/1985 |
| DE | 4417563 | A1 | 11/1995 |
| EP | 2753207 | A2 | 7/2014 |
| EP | 2862465 | A1 | 4/2015 |
| FR | 2765082 | A1 | 12/1998 |

OTHER PUBLICATIONS

Notice of Allowance dated Aug. 15, 2016 for Chinese Patent Application No. 2012800532534 and the English translation thereof.

Chinese Office Action dated Jan. 18, 2016 in Chinese Patient Appiication 201280053253.4.

Extended European Search Report dated Mar. 19, 2015 for European Application No. 14197120.0.

International Preliminary Report on Patentability (including Written Opinion of the ISA) for Application No. PCT/US2012/053401, dated Apr. 17, 2014.

International Search Report and Written Opinion for Application No. PCT/US2012/053401, dated Mar. 25, 2014.

Chinese Office Action dated Jul. 3, 2015 in Chinese Patent Application No. 201280053253.4.

* cited by examiner

ARTICLE OF FOOTWEAR WITH FOREFOOT SECONDARY STUDS

CROSS REFERENCE TO RELATED APPLICATION

This non-provisional U.S. Patent Application is a divisional of and claims priority under 35 U.S.C. 121 to U.S. application Ser. No. 13/228,602 entitled "Article Of Footwear With Forefoot Secondary Studs," filed on Sep. 9, 2011, which published as U.S. Patent Application Publication Number US 2013/0061498 on Mar. 14, 2013, and was allowed on Mar. 2, 2015, with a Corrected Notice of Allowability mailed on Apr. 10, 2015, the disclosure of which application is hereby incorporated by reference in its entirety.

BACKGROUND

The present embodiments relate generally to an article of footwear, and in particular to an article of footwear with secondary studs on the perimeter of the forefoot region of the sole.

Various competitive athletic activities require players to make changes in directional movement quickly on a variety of playing surfaces. For example, the game of soccer requires players to make many directional changes in response to the position of a soccer ball on the playing field. In order to allow the player to quickly change directions while moving at high rates of speed, studs may be provided on the sole of athletic footwear. The studs may provide a sufficient amount of friction between the ground and the player's foot in order to provide the player with the stability needed to keep their balance while changing directions. In particular, studs may be located on the forefoot region of the sole of the shoe to provide the necessary friction.

SUMMARY

In one aspect, the present disclosure is directed to an article of footwear comprising a sole structure having a forefoot region and a heel region, where the sole structure includes a peripheral side region. The peripheral side region extends between a bottom surface of the sole structure and a top surface of the sole structure. Furthermore, a first peripheral stud extends from the peripheral side region and has a first size, and a second peripheral stud extends from the peripheral side region, where the second peripheral stud has a second size that is greater than the first size. In addition, the second peripheral stud is disposed on a lateral side of the sole structure and the first peripheral stud is disposed on a medial side of the sole structure.

In another aspect, the present disclosure is directed to an article of footwear, comprising a sole structure having a forefoot region and a heel region, where the sole structure includes a bottom surface, a peripheral side surface that is substantially perpendicular to the bottom surface, and where the peripheral side surface extends between the bottom surface of the sole structure and a top surface of the sole structure. Furthermore, there is a plurality of peripheral studs including a forefoot peripheral stud set. The forefoot peripheral stud set includes a first peripheral stud and a second peripheral stud, where the first peripheral stud and the second peripheral stud extend from the side surface in the forefoot region. In addition, the first peripheral stud is disposed on a lateral side of the sole structure, and the second peripheral stud is disposed on a medial side of the sole structure. A first plurality of elongate studs also extend from the bottom surface of the sole adjacent to the medial side surface in the forefoot region, where a longitudinal axis of each of the first plurality of elongate studs runs in substantially the same direction as the peripheral side surface located proximate to the elongate stud. Additionally, a second plurality of elongate studs extend from the bottom surface of the sole adjacent to the lateral side surface in the forefoot region, where a longitudinal axis of each of the second plurality of elongate studs runs in substantially the same direction as the peripheral side surface located proximate to the elongate stud.

In another aspect, the present disclosure is directed to an article of footwear with a sole structure, the sole structure including a forefoot region, a heel region, a bottom surface, and a side surface, where the side surface is connected to the bottom surface. The sole structure also has an outer peripheral edge comprised of an outermost surface of the side surface, such that the side surface is substantially perpendicular to the bottom surface. There is a first wedge-shaped stud that extends beyond the outer peripheral edge of the forefoot region of the sole, where the first wedge-shaped stud has a height extending in a direction outwardly from the side surface. In addition, the first wedge-shaped stud has a length extending in a direction substantially parallel to the outer peripheral edge, and the height of the first wedge-shaped stud is less than the length of the first wedge-shaped stud. In addition, a plurality of elongate studs extend from the bottom surface of the sole in the forefoot region, where an elongate axis of each of the plurality of elongate studs is substantially parallel to the outer peripheral edge located proximate to the elongate stud. The plurality of elongate studs include a first elongate stud, where the first elongate stud includes at least one traction element disposed on a tip portion of the first elongate stud.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
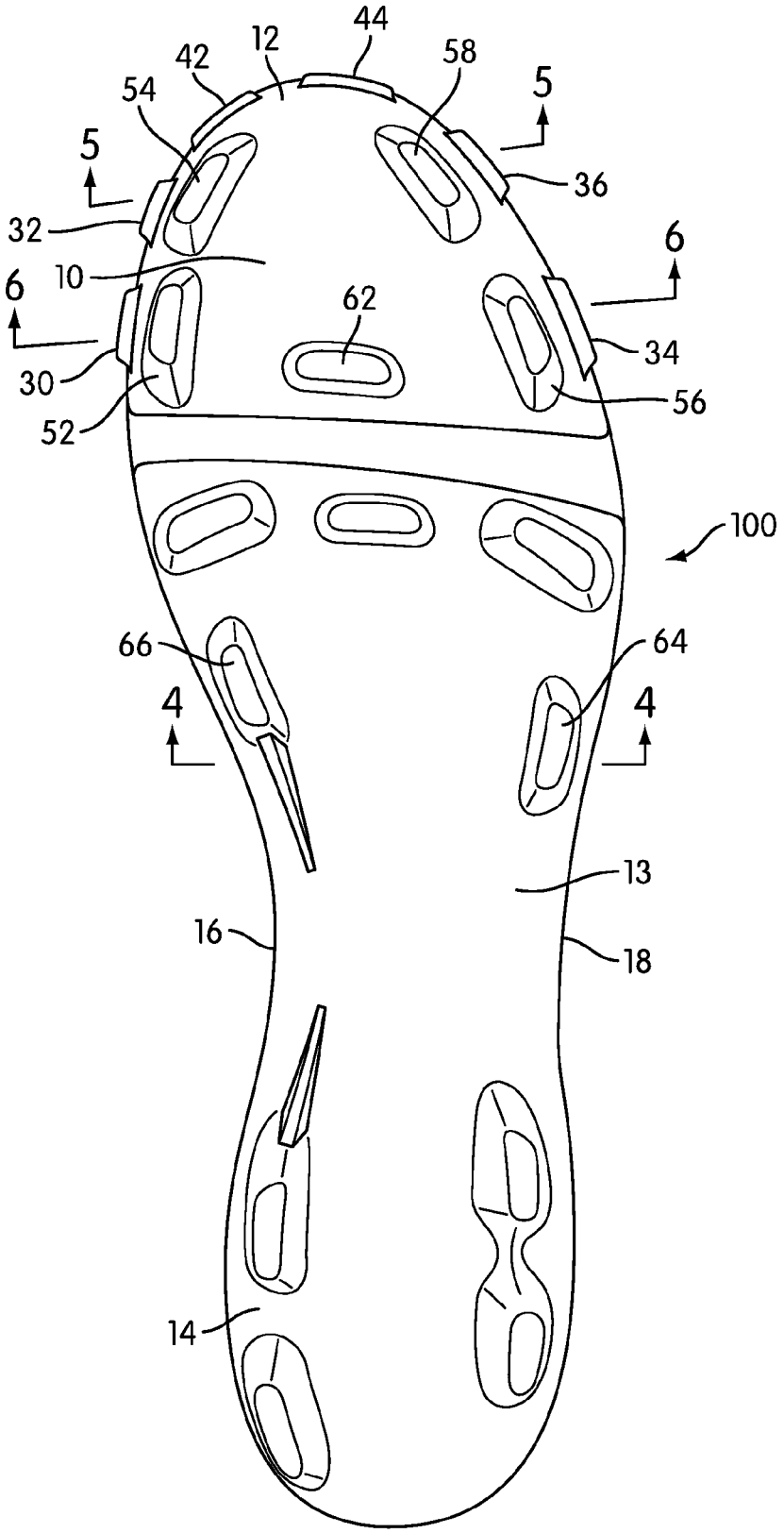
FIG. 1 is a bottom view of one embodiment of an article of footwear.

FIG. 1 illustrates a plan view of an embodiment of a sole structure 100, which may be incorporated into an article of footwear. For clarity, the following detailed description discusses an exemplary embodiment, in the form of a soccer shoe, but it should be noted that the present embodiment could take the form of a sole structure for any article of footwear including, but not limited to: hiking boots, soccer shoes, football shoes, sneakers, rugby shoes, basketball shoes, baseball shoes as well as other kinds of shoes. As shown in FIG. 1, sole structure 100 is intended to be used with a left foot; however, it should be understood that the following discussion may equally apply to a mirror image of sole structure 100 that is intended for use with a right foot.

For consistency and convenience, directional adjectives are employed throughout this detailed description corresponding to the illustrated embodiments. The term "longitudinal" or "longitudinally" as used throughout this detailed description and in the claims refers to a direction extending a length of a component. In some cases, the longitudinal axis is the axis extending through the longest dimension of a component. For example, the longitudinal axis of an elongated stud may be the direction extending through the longest portion of the elongated stud.

The term "medial plane of the body" as used throughout this detailed description and in the claims refers to the plane that divides the human body into a right and left side. The term "lateral" as used throughout this detailed description and in the claims refers to a region or direction extending away from the medial plane of the body. For example, the lateral side of the foot may refer to the side of the foot facing away from the center of the body. Similarly, the term "medial" as used throughout this detailed description and in the claims refers to a region or direction extending towards the medial plane of the body. For example, the medial side of the foot may refer to the side of the foot facing towards the center of the body.

Furthermore, the term "vertical" or "central" as used throughout this detailed description and in the claims refers to a direction that is generally perpendicular to a direction that is parallel to the ground when the sole of the shoe is facing the ground. Furthermore, the term "vertical axis" or "central axis" as used throughout this detailed description and in the claims refers to a direction that extends generally away from the sole of the foot and towards the ground when the sole of the shoe is facing the ground. For example, in cases where a sole is planted flat on a ground surface, the vertical or central direction may extend from the sole towards the ground surface. In some embodiments, the term "vertical," "central," "vertical axis," and/or central axis" may refer to a direction that is substantially parallel to the bottom surface of the sole. For example, in cases where the sole is not planted on a ground surface, the vertical or central direction may extend substantially perpendicular to the bottom surface of the sole. It will be understood that each of these directional adjectives may be applied to individual components of an article, such as an upper and/or a sole structure.

The studs discussed herein may vary in size in different dimensional directions. It should be understood that the terms "length" and "width" as used throughout this detailed description and in the claims refers to a direction generally associated with the longest and shortest dimensions, respectively, of an element in the plane parallel to the sole structure. It should also be understood that the term "height" as used throughout this detailed description and in the claims refers to a direction generally associated with the distance of an element as measured from the sole structure in the plane perpendicular to the sole structure. In some embodiments, the length and/or width of the studs may vary. Similarly, in some embodiments, the approximate heights of each stud may vary.

Additionally, it will be understood that while the current embodiments use elongated, rectangular and/or round cross-sectional shaped cleat or stud members, cleat or stud members may be formed in any of various shapes, including but not limited to hexagonal, cylindrical, conical, circular, square, rectangular, trapezoidal, diamond, ovoid, as well as other regular or irregular and geometric or non-geometric shapes.

Referring to FIG. 1, for purposes of reference, sole structure 100, or simply sole 100, may be divided into a forefoot region 10, midfoot region 13, and heel region 14. Forefoot region 10 may be generally associated with the toes and joints connecting the metatarsals with the phalanges. The forefoot region 10 may further include a front-tip region 12 associated with the front tip of the sole 100. Midfoot region 13 may be generally associated with the arch of a foot. Likewise, heel region 14 may be generally associated with the heel of a foot, including the calcaneus bone.

In addition, sole 100 may include a medial edge 16 and lateral edge 18. In particular, medial edge 16 may refer to the edge of the sole 100 facing away from the center of the body. Similarly, the lateral edge 18 may refer to the region of the sole 100 that is facing towards the center of the body. Furthermore, both medial edge 16 and lateral edge 18 may extend through forefoot region 10, midfoot region 13, and heel region 14.

It will be understood that forefoot region 10, midfoot region 13, and heel region 14 are only intended for purposes of description and are not intended to demarcate precise regions of sole 100. Likewise, medial edge 16 and lateral edge 18 are intended to represent generally two portions or sides of the sole 100, rather than precisely demarcating the sole 100 into two halves. In addition, forefoot region 10, midfoot region 13, and heel region 14, as well as medial edge 16 and lateral edge 18, can also be applied to individual components of an article of footwear, such as a sole structure and/or an upper.

In some embodiments, sole 100 may be configured to provide traction for the wearer. In addition to providing traction, sole 100 may attenuate ground reaction forces when compressed between the foot and the ground during walking, running or other ambulatory activities. The configuration of sole 100 may vary significantly in different embodiments to include a variety of conventional or non-conventional structures. In some embodiments, sole 100 may include different components. For example, sole 100 may include an outsole, a midsole, and/or an insole. In some cases, one or more of these components may be optional.

In some cases, sole 100 may be configured according to one or more types of ground surfaces on which sole 100 may be used. Examples of ground surfaces include, but are not limited to: natural turf, synthetic turf, dirt, natural grass, soft natural grass, as well as other surfaces. In some embodiments, sole 100 may be provided with one or more cleat or stud systems comprising a plurality of cleat members. The term "cleat members" or "stud members" as used in this detailed description and throughout the claims includes any provisions disposed on a sole for increasing traction through friction or penetration of a ground surface. Typically, cleat systems, stud systems, cleat members and/or stud members may be configured for football, soccer, baseball or any type of activity that requires traction.

Sole 100 may include one or more cleat or stud systems comprising a plurality of cleat or stud members that extend away from the surface of the sole 100. Generally, cleat or stud systems and/or cleat or stud members may be associated with sole 100 in any manner. In some embodiments, cleat or stud systems and/or cleat or stud members may be integrally formed with sole 100. In other embodiments, sole 100 may include a partially rigid plate that extends across a substantial majority of a lower surface of sole 100. In some cases, cleats or stud systems and/or cleat or stud members may be attached to a partially rigid plate, such as by being screwed into holes within the plate or using any other provisions. Still further, in some cases, some cleat or stud systems and/or cleat or stud members may be integrally formed with sole 100. In still other cases, cleat or stud systems and/or cleat or stud members may be attached to and/or integrally formed with a partially rigid plate.

An article of footwear including cleat or stud systems and/or cleat or stud members can include provisions for maximizing traction between a sole and multiple types of ground surfaces. In some embodiments, a sole 100 can include cleat or stud systems and/or cleat or stud members disposed in different locations to achieve maximum traction on multiple types of surfaces. In other embodiments, a sole 100 can include distinct types of cleat or stud systems and/or cleat or stud members that each maximize traction for a distinct type of surface.

In some embodiments, sole 100 may include cleat or stud members arranged as shown in FIG. 1 in the forefoot region 10 and midsole region 13. In other embodiments, the sole 100 may include cleat or stud members and/or cleat or stud systems arranged in any other kind of configuration.

FIG. 1 also shows cleat or stud members in the forefoot region 10 according to one embodiment. Referring to FIG. 1, the medial edge 16 of the forefoot region 10 of the sole may include a first wedge-shaped stud 30 and a second wedge-shaped stud 32 extending outwardly from the surface of the sole. Similarly, the lateral edge 18 of the forefoot region 10 of the sole may include a third wedge-shaped stud 34 and a fourth wedge-shaped stud 36. In some embodiments, first wedge-shaped stud 30, second wedge-shaped stud 32, third wedge-shaped stud 34, and fourth wedge-shaped stud 36 may be wedge-shaped. Also shown in FIG. 1 is fifth wedge-shaped stud 42 and a sixth wedge-shaped stud 44 associated with the front tip region 12 of the forefoot 10.

Although the studs along the perimeter of the forefoot region 10 shown in FIG. 1 are wedge-shaped, these studs may be in the form of other shapes. For example, the cross-section of the studs may form a trigon, or triangular shape. As further example, the cross-section of the studs may form a quadrilateral, or any other polygon.

FIG. 1 also shows a plurality of elongated studs in the forefoot region 10 of the sole located in an inward direction relative to the wedge-shaped studs. In some embodiments, "elongated studs" or "elongated cleats" may also be referred to as "blade studs" or "blade cleats." Referring to FIG. 1, the forefoot region 10 may include a first elongated stud 52 and second elongated stud 54 associated with the medial edge 16 of the sole. The first elongated stud 52 may be located inward of the first wedge-shaped stud 30, and second elongated stud 54 may be located inward of the second wedge-shaped stud 32. In some cases, the first elongated stud 52 and second elongated stud 54 may be elongated in a direction that is substantially parallel to the medial edge 16 of the sole in the forefoot region 10.

The forefoot region 10 may also include a third elongated stud 56 and fourth elongated stud 58 associated with the lateral edge 18 of the sole. The third elongated stud 56 may be located inward of the third wedge-shaped stud 34 and fourth elongated stud 58 may be located inward of the fourth wedge-shaped stud 36. In some cases, the third elongated stud 56 and fourth elongated 58 may be elongated in a direction that is substantially parallel to the lateral edge 18 of the sole in the forefoot region 10.

In some embodiments, sole structure 100 can include a fifth elongated stud 62 that is disposed in the center of the sole structure 100 in the forefoot region 10. In some cases, the fifth elongated stud 62 may be elongated in a direction that is substantially transverse to the medial edge 16 and/or lateral edge 18 of the sole. In some embodiments, the fifth elongated stud 62 may generally provide increased friction between the player and the ground surface in order to improve the player's stability. In some embodiments, the fifth elongated stud 62 may also provide the player with enough friction to more quickly accelerate to an increased speed. In other embodiments, however, fifth elongated stud 62 may be optional.

Figure 2:
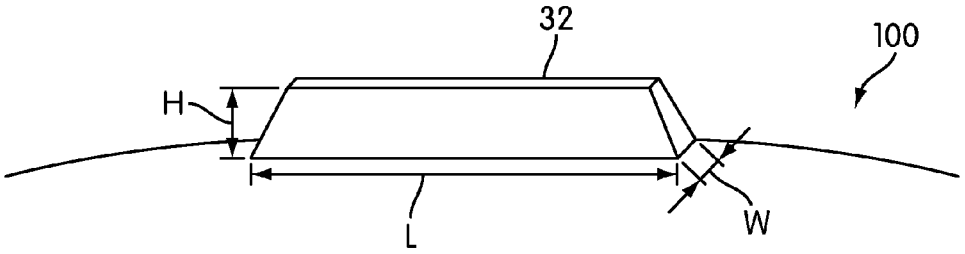
FIG. 2 is an enlarged perspective view of an embodiment of a wedge-shaped stud in the forefoot region.

FIG. 2 is an enlarged perspective view showing the dimensions of one embodiment of a second wedge-shaped stud 32 on sole 100. As can be seen in FIG. 2, second wedge-shaped stud 32 may be approximately wedge-shaped. In other words, the length L of second wedge-shaped stud 32 may be larger than its height H and its width W. Similarly, the width W of second wedge-shaped stud 32 may be smaller than both its height H and its length L. In some embodiments, these proportional dimensions may also be similar for the first wedge-shaped stud 30, third wedge-shaped stud 34, fourth wedge-shaped stud 36 and/or any other wedge-shaped stud located on the sole 100. In some embodiments, these proportional dimensions may also be similar for the fifth wedge-shaped stud 42 and sixth wedge-shaped stud 44 in the front tip 12 of the forefoot region 10 of the sole 100.

Figure 3:
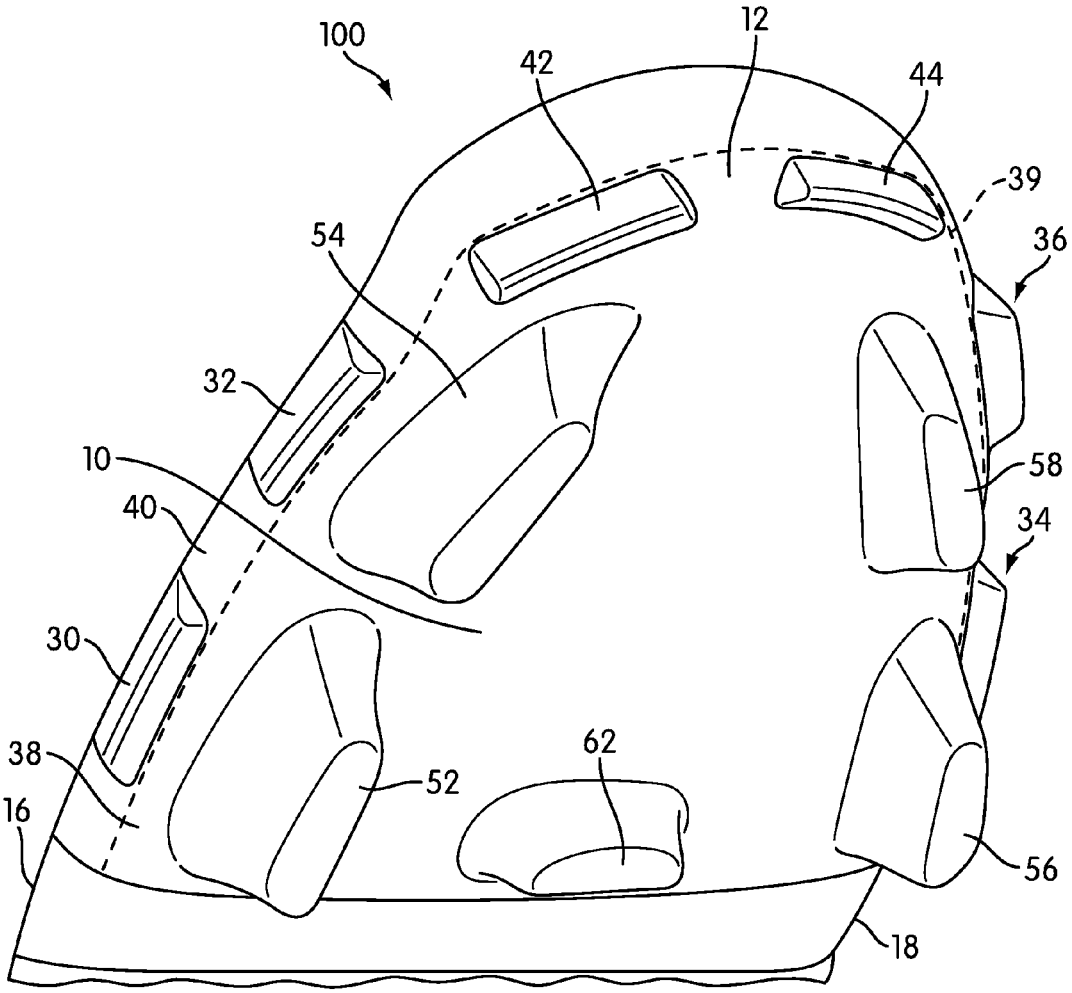
FIG. 3 is a perspective view of the embodiment of an article of footwear shown in FIG. 1.

FIG. 3 is an enlarged perspective view of the embodiment of the forefoot region 10 shown in FIG. 1. FIG. 3 shows one embodiment of the placement of studs on a curved bottom surface of the forefoot 10 of the sole 100. Referring to FIG. 3, the forefoot 10 of the sole 100 may include a bottom surface region 38 that is designed to be facing the ground when worn on a foot. The sole may have a transition region 39 along the outer perimeter of the forefoot region 10 where the sole 100 of the foot begins to curve upwards from the ground. The sole 100 may have a side region 40 outward of the transition region 39. The side region 40 is designed to be substantially perpendicular to the ground when worn on the foot. In other words, the side region 40 is designed to be substantially perpendicular to the bottom surface region 38.

In some embodiments, a sole structure 100 can include provisions for facilitating pulling ground engaging studs out of the ground as a player makes lateral and/or medial cuts on the playing field. This may enable a player to make lateral and/or medial cuts more easily and more quickly. In some embodiments, a sole structure 100 may include studs that are primarily configured for ground engagement. In some embodiments, the sole structure 100 may include studs that provide leverage for helping to pull or remove the ground engaging studs from the ground while making lateral and/or medial cuts. In some embodiments, the studs that provide leverage may be disposed on a side of the sole surface, e.g., outside of a peripheral edge, which is discussed in more detail below.

As can be seen in the FIG. 3, the first elongated stud 52, second elongated stud 54, third elongated stud 58, fourth elongated stud 56 and fifth elongated stud 62 may be located in the bottom surface region 38. Since these studs are positioned on the bottom surface region 38 of the sole 100, the primary purpose of the first elongated stud 52, second elongated stud 54, third elongated stud 56, fourth elongated stud 58 and fifth elongated stud 62 may be to engage the ground in order to provide friction between the player and the ground. However, these studs may also serve various other purposes, such as to anchor a foot into the ground. In other embodiments, these studs can provide other functions for sole 100.

In some embodiments, fifth wedge-shaped stud 42 and a sixth wedge-shaped stud 44 associated with the front tip region 12 of the forefoot 10 may also be located in the bottom surface region 38. However, in some embodiments, fifth wedge-shaped stud 42 and a sixth wedge-shaped stud 44 may be located in the side region 40 of the sole 100. In some embodiments, as shown in FIG. 3, the first wedge-shaped stud 30 and second wedge-shaped stud 32 may be located in the side region 40 of the forefoot 10. Similarly, the third wedge-shaped stud 34 and fourth wedge-shaped stud 36 may be located in the side region 40 of the forefoot 10. However, in some embodiments the first wedge-shaped stud 30, second wedge-shaped stud 32, third wedge-shaped stud 34 and fourth wedge-shaped stud 36 may be located in the transition region 39 or in the bottom surface region 38 of the forefoot 10.

Figure 4:
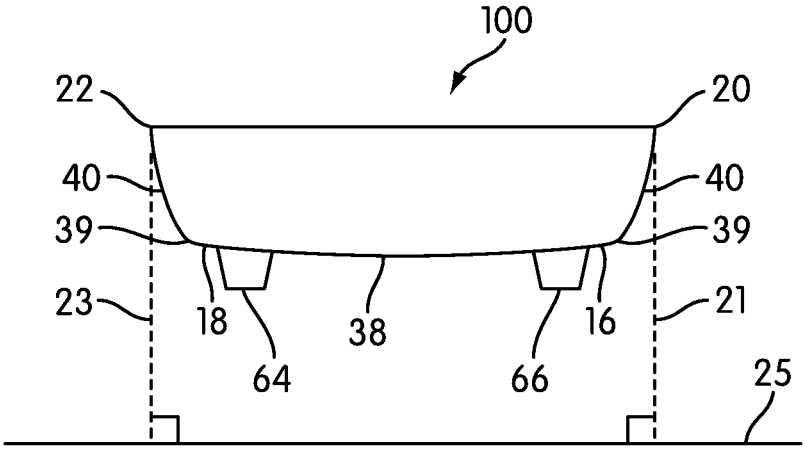
FIG. 4 is a cross-section of the sole of the article of footwear shown in FIG. 1 taken along the line 4-4 in the midfoot region.

FIG. 4 shows a cross-section of the sole 100 shown in FIG. 1 along line 4-4 in the midfoot region 13. FIG. 4 shows a more detailed view of the bottom surface region 38, transition region 39, and side region 40. The sole 100 in FIG. 4 is shown facing the ground 25 as when worn by a player or user. The "outer medial peripheral edge" 20 as used throughout the specification and claims may be defined as the outermost medial surface along the medial side 16 of the sole 100. In some embodiments, the outer medial peripheral edge 20 may be defined by the medial surface of the sole 100 that passes through the outermost plane 21 that forms a right angle with the ground 25, when bottom surface region 38 is facing the ground 25. In some embodiments, the outermost plane 21 will extend in a vertical direction from the sole 100. In some embodiments, the outermost plane 21 will extend in a direction that is substantially perpendicular to the bottom surface region 38 of the sole 100. The outer medial peripheral edge 20 in FIG. 4 may extend the entire medial side of the sole 100, from the forefoot region 10 through the heel region 14 (see FIG. 1). Generally, the outer medial peripheral edge 20 is located in the side region 40 of the sole 100. However, the outer medial peripheral edge 20 may also be located in the transition region 39 of the sole 100.

Similarly, the "outer lateral peripheral edge" 22 as used throughout the specification and claims may be defined by the outermost lateral surface along the lateral side 18 of the sole 100. In some embodiments, the outer lateral peripheral edge 22 may be defined by the lateral surface of the sole 100 that passes through the outermost plane 23 that forms a right angle with the ground 25, when the bottom surface region 38 is facing the ground 25. In some embodiments, the outermost plane 23 will extend in a vertical direction from the sole 100. In some embodiments, the outermost plane 23 will extend in a direction that is substantially perpendicular to the bottom surface region 38 of the sole 100. The outer lateral peripheral edge 22 in FIG. 4 may extend the entire lateral side of the sole 100, from the forefoot region 10 through the heel region (not shown in FIG. 4). Generally, the outer lateral peripheral edge 22 is located in the side region 40 of the sole 100. However, the outer lateral peripheral edge 22 may also be located in the transition region 39 of the sole 100.

In some embodiments, different regions of the sole may have studs located within the outer lateral peripheral edge 22 and/or the outer medial peripheral edge 20 of the sole 100. For example, in some embodiments, the forefoot region 10 may include studs located within the outer lateral peripheral edge 22 and/or the outer medial peripheral edge of the forefoot region 10 of the sole 100. In some embodiments, studs may be located within the outer lateral peripheral edge 22 and/or the outer medial peripheral edge 20 of the heel region 14 of the sole 100. In some embodiments, studs may be located within the outer lateral peripheral edge 22 and/or the outer medial peripheral edge 20 of the midfoot region 13 of the sole 100. In some embodiments, studs may be located within the outer lateral peripheral edge 22 and/or the outer medial peripheral edge 20 of any combination of the forefoot region 10, midfoot region 13 or heel region 14 of the sole 100. In other embodiments, studs may be located within the outer lateral peripheral edge 22 and/or the outer medial peripheral edge 20 in areas other than the forefoot region 10, midfoot region 13 and heel region 14 of the sole 100. In still other embodiments, different regions of the sole 100 may have no studs located within the outer lateral peripheral edge 22 and/or outer medial peripheral edge 20.

In some embodiments, as shown in FIG. 4, the midfoot region 13 may have no studs located along the outer lateral peripheral edge 22 or outer medial peripheral edge 20. However, some embodiments may include studs along the outer lateral peripheral edge 22 and/or outer medial peripheral edge 20. In some embodiments, the midfoot region 13 may include a first midfoot elongated stud 64 and second midfoot elongated stud 66 located on the bottom surface region 38 of the sole 100, which inside the transition region 39. However, in some embodiments the midfoot region 13 may have no elongated studs located on the bottom surface region 38 inside the transition region 39 of the sole 100.

Figure 5:
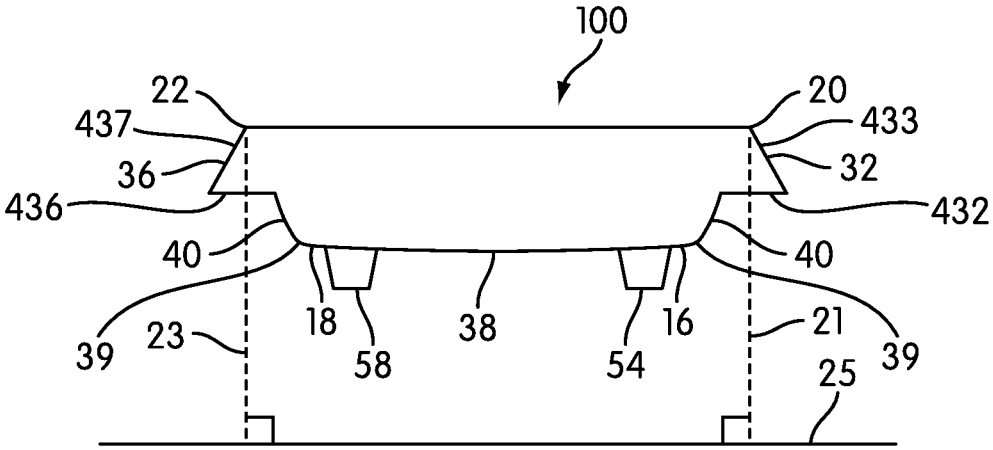
FIG. 5 is a cross-section of the sole of the article of footwear shown in FIG. 1 taken along the line 5-5 in the forefoot region.

FIG. 5 shows a cross-section of the sole 100 shown in FIG. 1 along line 5-5 in the forefoot region 10. FIG. 5 shows a more detailed view of the positioning of the second wedge-shaped stud 32 and the fourth wedge-shaped stud 36 on the surface of the sole 100. The sole 100 shown in FIG. 5 has an outer medial peripheral edge 20 that extends the entire medial side 16 of the sole 100, including the forefoot region 10. As shown in FIG. 5, the second wedge-shaped stud 32 may be located in the side region 40 of the sole 100 of the forefoot 10. The second wedge-shaped stud 32 may extend beyond the outer medial peripheral edge 20, and/or outer medial plane 21, as shown in FIG. 5.

In some embodiments, the second wedge-shaped stud 32 may include an angled surface 433 and a downward facing surface 432. In some embodiments, both the angled surface 433 and the downward facing surface 432 extend beyond the outer medial peripheral edge 20, and/or outer medial plane 21. In some embodiments, the downward facing surface 432 may extend substantially parallel to the ground 25, when bottom surface region 38 is parallel with ground 25. In some embodiments, the downward facing surface 432 may extend substantially parallel with the bottom surface region 38 of the sole 100. In some embodiments, the bottom surface region 38 may be curved or rounded, in which case the downward facing surface 432 may be substantially parallel to the flattest portion (e.g., near the center) of bottom surface region 38. However, in some embodiments, the downward facing surface 432 may extend at some angle relative to the ground 25 and/or bottom surface region 38 of the sole 100.

Similarly, the sole 100 shown in FIG. 5 has an outer lateral peripheral edge 22 that extends the entire lateral side 18 of the sole 100, including the forefoot region 10. As shown in FIG. 5, the fourth wedge-shaped stud 36 may be located in the side region 40 of the sole 100 of the forefoot 10. The fourth wedge-shaped stud 36 may extend beyond the outer lateral peripheral edge 22, and/or outer lateral plane 23, as shown in FIG. 5.

In some embodiments, the fourth wedge-shaped stud 36 may include an angled surface 437 and a downward facing surface 436. In some embodiments, both the angled surface 437 and the downward facing surface 436 extend beyond the outer lateral peripheral edge 22, and/or outer lateral plane 23. In some embodiments, the downward facing surface 436 may extend substantially parallel to the ground 25, when bottom surface region 38 is parallel with ground 25. In some embodiments, the downward facing surface 436 may extend substantially parallel with the bottom surface region 38 of the sole 100. In some embodiments, the bottom surface region 38 may be curved or rounded, in which case the downward facing surface 436 may be substantially parallel to the flattest portion (e.g., near the center) of bottom surface region 38. However, in some embodiments, the downward facing surface 436 may extend at some angle relative to the ground 25 and/or bottom surface region 38 of the sole 100.

Figure 6:
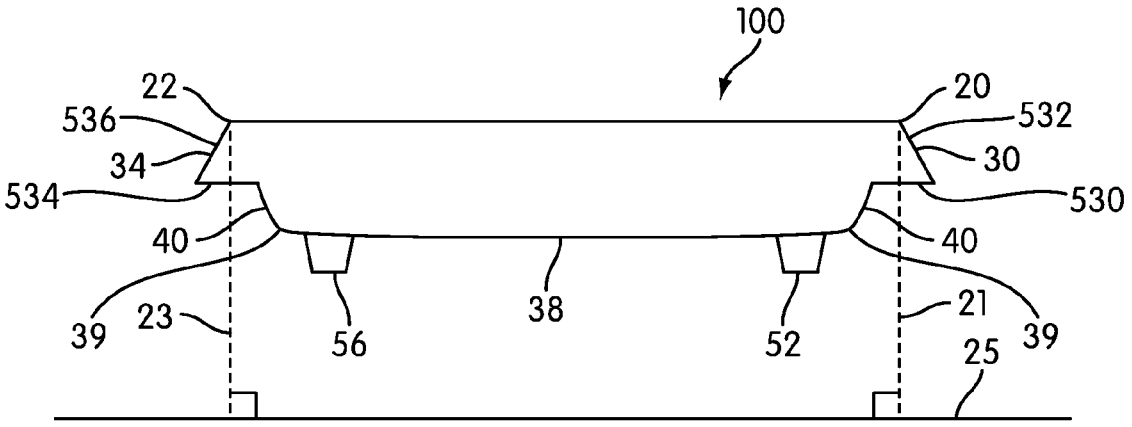
FIG. 6 is a cross-section of the sole of the article of footwear shown in FIG. 1 taken along the line 6-6 in the forefoot region.

FIG. 6 shows a cross-section of the sole 100 shown in FIG. 1 along line 6-6 in the forefoot region 10. FIG. 6 shows a more detailed view of the positioning of the third wedge-shaped stud 34 and the first wedge-shaped stud 30 on the surface of the sole 100. The sole 100 shown in FIG. 6 has an outer medial peripheral edge 20 that extends the entire medial side 16 of the sole 100, including the forefoot region 10. As shown in FIG. 6, the first wedge-shaped stud 30 may be located in the side region 40 of the sole 100 of the forefoot 10. The first wedge-shaped stud 30 may extend beyond the outer medial peripheral edge 20, and/or outer medial plane 21, as shown in FIG. 6.

In some embodiments, the first wedge-shaped stud 30 may include an angled surface 532 and a downward facing surface 530. In some embodiments, both the angled surface 532 and the downward facing surface 530 extend beyond the outer lateral peripheral edge 20, and/or outer lateral plane 21. In some embodiments, the downward facing surface 530 may extend substantially parallel to the ground 25, when bottom surface region 38 is parallel with ground 25. In some embodiments, the downward facing surface 530 may extend substantially parallel with the bottom surface region 38 of the sole 100. In some embodiments, the bottom surface region 38 may be curved or rounded, in which case the downward facing surface 530 may be substantially parallel to the flattest portion (e.g., near the center) of bottom surface region 38. However, in some embodiments, the downward facing surface 530 may extend at some angle relative to the ground 25 and/or bottom surface region 38 of the sole 100.

Similarly, the sole 100 shown in FIG. 6 has an outer lateral peripheral edge 22 that extends the entire lateral side 18 of the sole 100, including the forefoot region 10. As shown in FIG. 6, the third wedge-shaped stud 34 may be located in the side region 40 of the sole 100 of the forefoot 10. The third wedge-shaped stud 34 may extend beyond the outer lateral peripheral edge 22, and/or outer lateral plane 23, as shown in FIG. 6.

In some embodiments, the third wedge-shaped stud 34 may include an angled surface 536 and a downward facing surface 534. In some embodiments, both the angled surface 536 and the downward facing surface 534 extend beyond the outer lateral peripheral edge 22, and/or outer lateral plane 23. In some embodiments, the downward facing surface 534 may extend substantially parallel to the ground 25, when bottom surface region 38 is parallel with ground 25. In some embodiments, the downward facing surface 534 may extend substantially parallel with the bottom surface region 38 of the sole 100. In some embodiments, the bottom surface region 38 may be curved or rounded, in which case the downward facing surface 534 may be substantially parallel to the flattest portion (e.g., near the center) of bottom surface region 38. However, in some embodiments, the downward facing surface 534 may extend at some angle relative to the ground 25 and/or bottom surface region 38 of the sole 100.

The configuration of the first wedge-shaped stud 30, second wedge-shaped stud 32, third wedge-shaped stud 34 and fourth wedge-shaped stud 36 provides leverage on the outer side region 40 of the sole 100. By providing leverage in the outer side region 40 of the sole, the player is able to more easily pull the elongated cleats located on the bottom surface region 38 of the sole out of the ground. This allows the player to make lateral and/or medial cuts more easily and more quickly.

Figure 7:
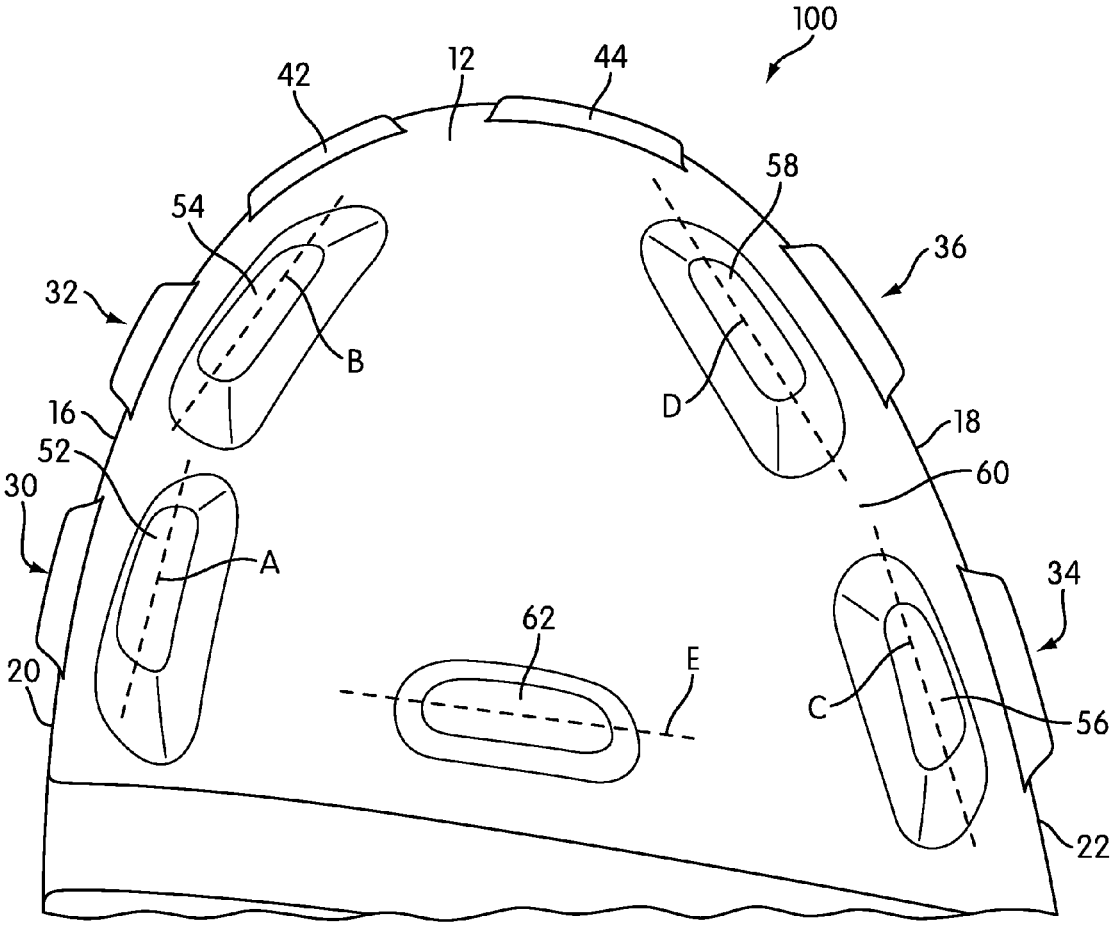
FIG. 7 is an enlarged bottom view of an embodiment of the article of footwear in the forefoot region.

FIG. 7 is an enlarged bottom view of the embodiment of the forefoot region 10 shown in FIGS. 1 and 3. As can be seen in FIG. 7, the wedge-shaped studs along the edge of the forefoot region 10 may extend beyond the perimeter of the sole 100. Referring to FIG. 7, the forefoot region 10 may include a medial peripheral edge 20 and a lateral peripheral edge 22. The first wedge-shaped stud 30 and second wedge-shaped stud 32 may extend beyond the outer medial peripheral edge 20 of the medial edge 16 of the sole 100. Similarly, the third wedge-shaped stud 34 and fourth wedge-shaped stud 36 may extend beyond the outer lateral peripheral edge 22 of the sole 100.

As can be seen in FIG. 7, the orientation of the wedge-shaped studs in the forefoot region 10 may extend beyond the outer medial peripheral edge 20 and/or outer lateral peripheral edge 22 of the sole 100. FIG. 7 also shows one embodiment of orienting the elongated cleats in the forefoot region 10.

FIG. 7 also shows a fifth wedge-shaped stud 42 and a sixth wedge-shaped stud 44 in the front tip 12 region of the sole 100. Although FIG. 7 shows only two studs in the front tip 12 of the forefoot region 10 of the sole 100, other embodiments may include more or less studs. In some embodiments, the fifth wedge-shaped stud 42 may extend beyond the outer medial peripheral edge 20 of the lateral side 16 of the forefoot 10 of the sole 100. In other embodiments, the fifth wedge-shaped stud 42 may not extend beyond the outer medial peripheral edge 20 of the forefoot 10 of the sole 100. In some embodiments, the sixth wedge-shaped stud 44 may extend beyond the outer lateral peripheral edge 22 of the forefoot 10 of the sole 100. In other embodiments, the sixth wedge-shaped stud 44 may not extend beyond the outer lateral peripheral edge 22 of the forefoot 10 of the sole 100.

In some embodiments, as shown in FIG. 7, a first elongated stud 52, second elongated stud 54, third elongated stud 56 and fourth elongated stud 58 may extend from the bottom surface 60 of the forefoot 10 of the sole 100. As can be seen in FIG. 7, longitudinal axis A of first elongated stud 52 may be substantially parallel to the adjacent outer medial peripheral edge 20 of the medial side 16 of the forefoot 10 of the sole 100. Similarly, longitudinal axis B of the second elongated stud 54 may be substantially parallel to the adjacent outer medial peripheral edge 20 of the medial side 16 of the forefoot 10 of the sole 100.

Additionally, the longitudinal axis C of the third elongated stud 56 may be substantially parallel to the adjacent outer lateral peripheral edge 22 of the lateral side 18 of the forefoot 10 of the sole 100. Similarly, the longitudinal axis D of the fourth elongated stud 58 may be substantially parallel to the adjacent outer lateral peripheral edge 22 of the lateral side 18 of the forefoot 10 of the sole 100.

In one embodiment, as shown In FIG. 7, a fifth elongated stud 62 may extend from the bottom surface 60 of the forefoot region 10 of sole 100. The fifth elongated stud 62 may be located near the center of the forefoot region 10 of the sole 100. The fifth elongated stud 62 may have a longitudinal axis E that runs substantially transverse to the other elongated studs in the forefoot region 10. In other words, the longitudinal axis E of the fifth elongated stud 62 may be oriented substantially perpendicular to the axis of elongation of the first elongated stud 52, second elongated stud 54, third elongated stud 56 and/or fourth elongated stud 58. In some embodiments, the fifth elongated stud 62 may have a longitudinal axis E that runs substantially transverse to the outer medial peripheral edge 20 and/or outer lateral peripheral edge 22 of the forefoot 10 of the sole 100.

Figure 8:
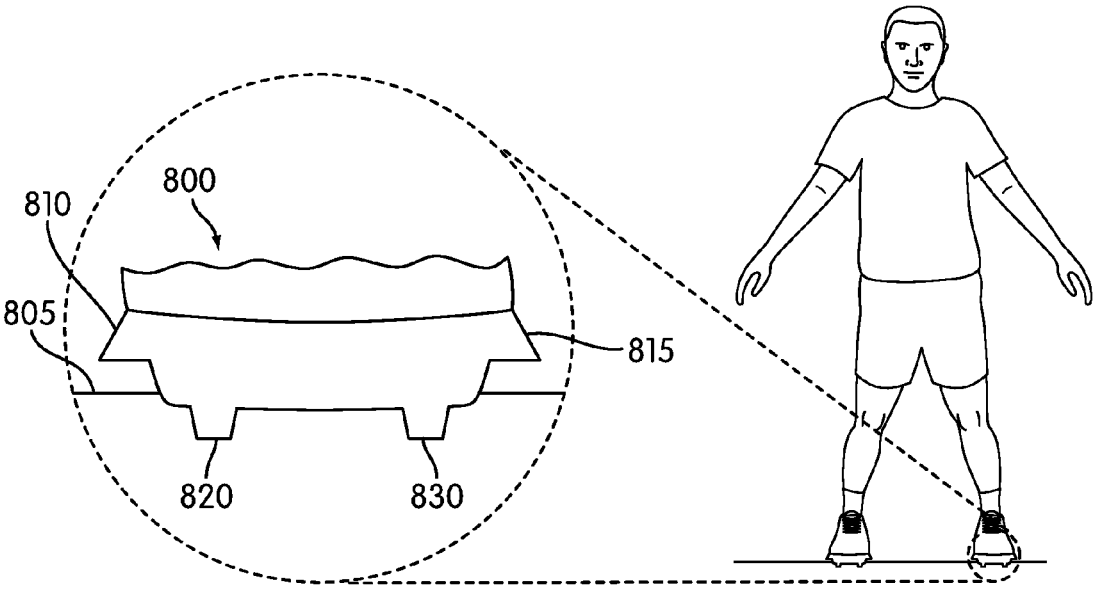
FIG. 8 is an enlarged view of and embodiment of wedge-shaped studs as the foot of a player is planted on the ground.
Figure 9:
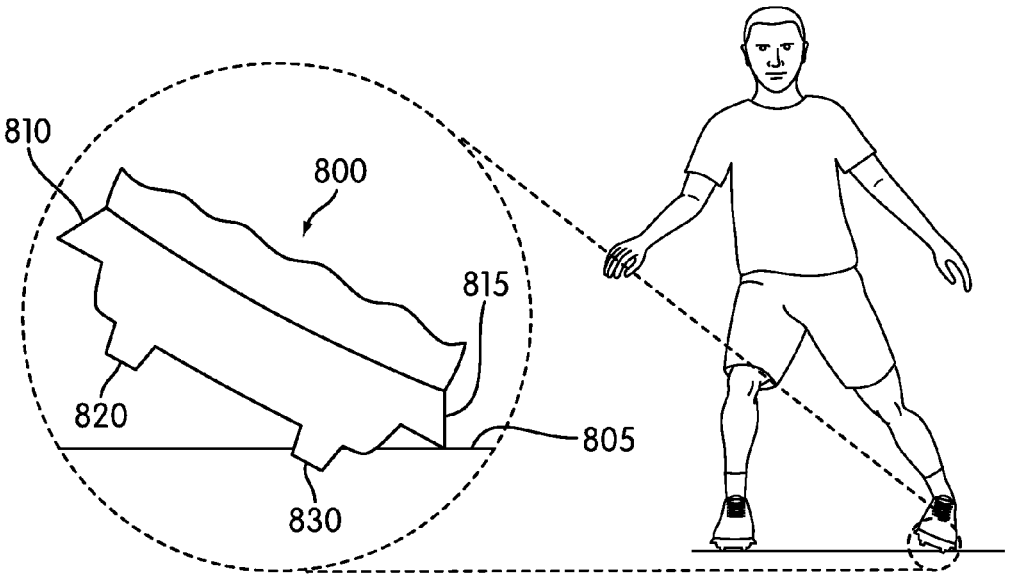
FIG. 9 is an enlarged view of an embodiment of wedge-shaped studs as the foot of a player is disengaging from the ground.

FIGS. 8-9 illustrate how the wedge-shaped studs provide additional leverage in order to disengage the elongated studs on the bottom surface of the sole. Referring to FIG. 8, the player's foot may be planted on the ground with at least a lateral elongated stud 830 and a medial elongated stud 820 inserted into the playing surface 805. The sole 800 may include at least a lateral wedge-shaped stud 815 and a medial wedge-shaped stud 810, which is not engaged in the ground 805.

In FIG. 9, the player is attempting to make a lateral cut, causing the sole 800 to tilt to the lateral side. As the sole 800 tilts to the lateral side, the lateral wedge-shaped stud 815 engages with the ground 805 providing sufficient leverage to remove medial elongated stud 820 from the ground 805. The lateral wedge-shaped stud 815 also provides leverage in order to eventually remove lateral elongated stud 830 from the ground 805 in order to complete the player's lateral cut. Although FIGS. 8-9 illustrate a lateral cut, wedge-shaped studs may also provide leverage for medial cuts.

Figure 10:
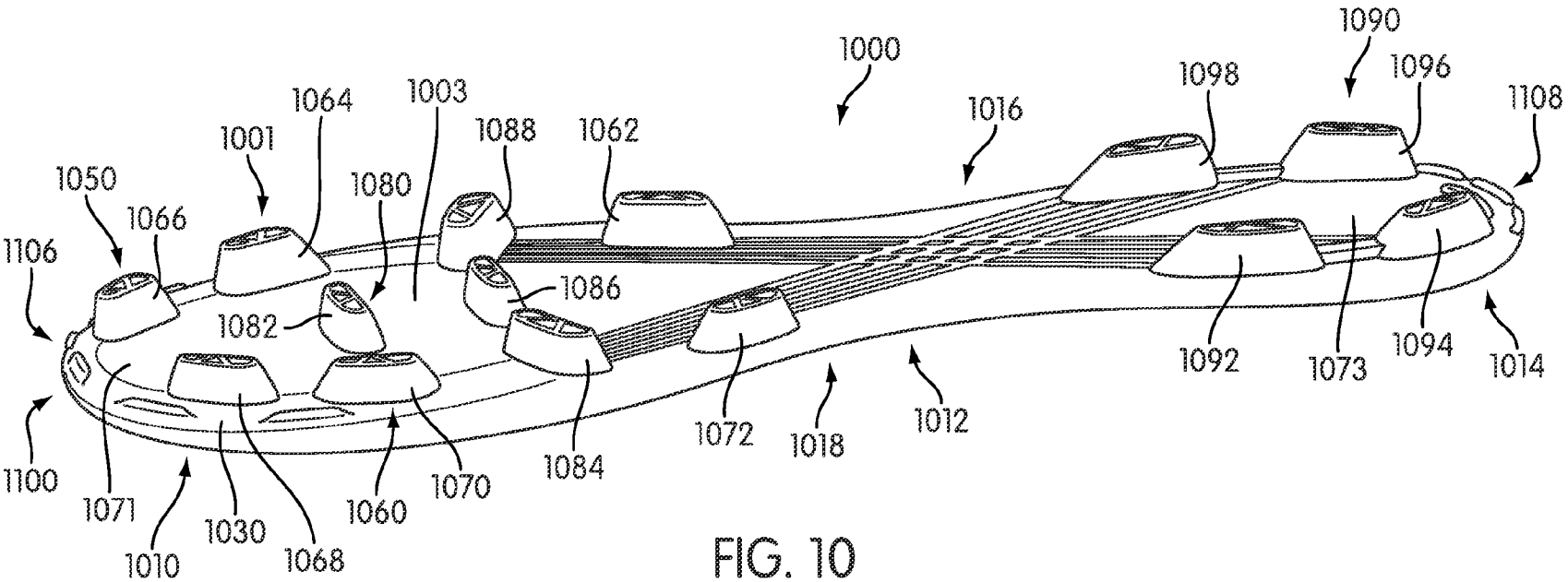
FIG. 10 is an isometric view of an embodiment of a bottom surface of a sole structure including a cleat system.
Figure 11:
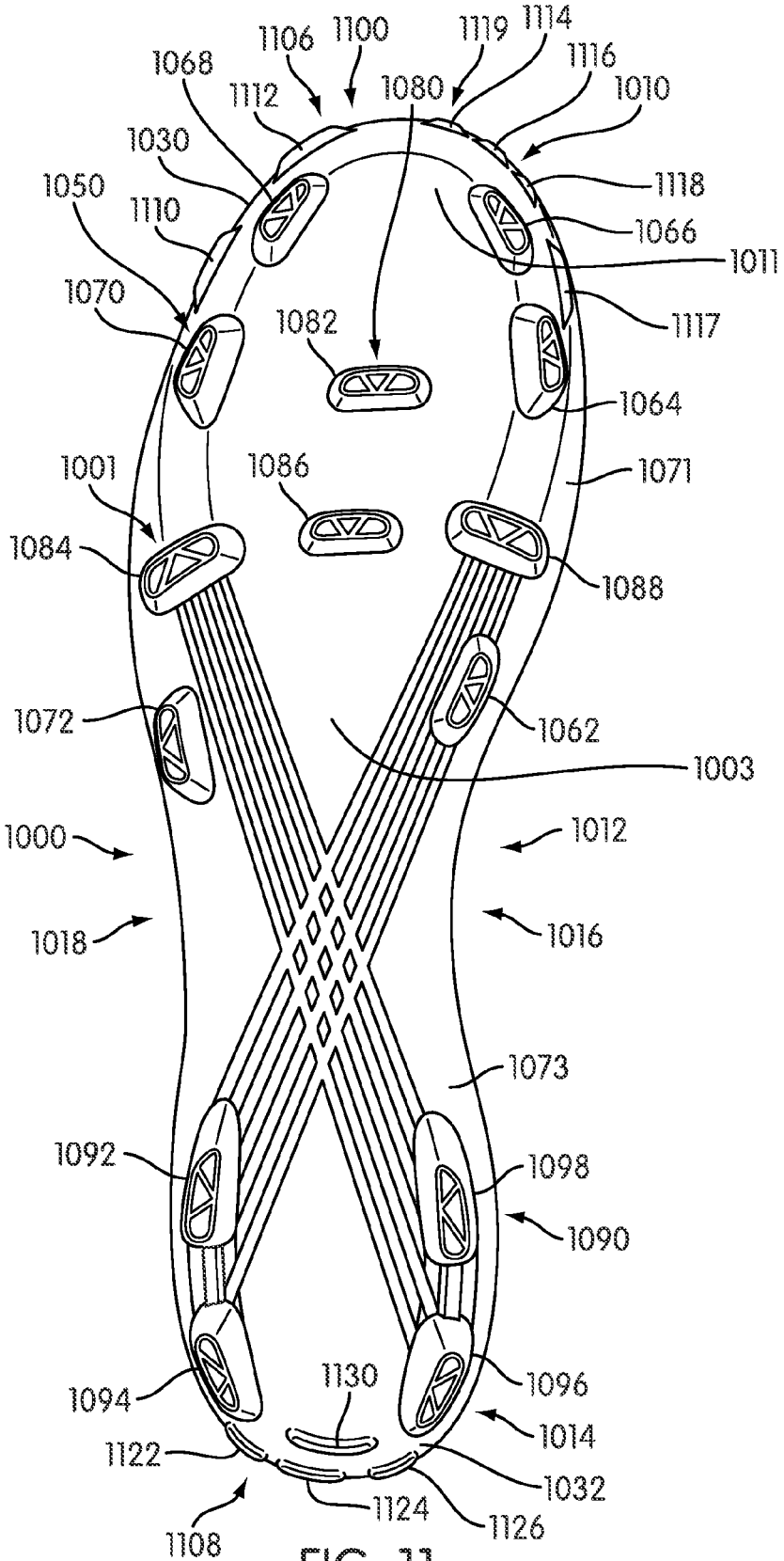
FIG. 11 is a bottom view of the sole structure of FIG. 10.

FIGS. 10 through 14 illustrate an alternative embodiment of a sole structure 1000. Referring now to FIGS. 10 and 11, sole 1000 can be divided into forefoot region 1010, midfoot region 1012 and heel region 1014. Additionally, sole 1000 can be divided into medial side 1016 and lateral side 1018.

Sole 1000 could be substantially similar to sole 100 of the embodiments disclosed above with reference to FIGS. 1 through 9. In particular, sole 1000 may include one or more cleat or stud systems comprising a plurality of cleat or stud members that extend away from the surface of the sole 1000. Generally, cleat or stud members may be associated with sole 1000 in any manner. In some embodiments, cleat or stud members may be integrally formed with sole 1000. In other embodiments, sole 1000 may include a partially rigid plate that extends across a substantial majority of a lower surface of sole 1000. In some cases, cleat or stud members may be attached to a partially rigid plate, such as by being screwed into holes within the plate or using any other provisions. Still further, in some cases, some cleat or stud members may be integrally formed with sole 1000. In still other cases, cleat or stud members may be attached to and/or integrally formed with a partially rigid plate.

As with the previous embodiments, sole 1000 may include a cleat system 1001 that comprises one or more types of cleats. In some cases, sole 1000 may include one or more elongated studs. In one embodiment, sole 1000 includes plurality of elongated studs 1050. Plurality of elongated studs 1050 can include studs arranged in a substantially similar configuration to the studs of the previous embodiments. For example, one possible configuration includes first set of elongated studs 1060 that comprises stud 1062, stud 1064, stud 1066, stud 1068, stud 1070 and stud 1072. First set of studs 1060 generally extend around lower periphery 1071 of forefoot region 1010. Additionally, second set of elongated studs 1080, including stud 1082, stud 1084, stud 1086 and stud 1088 may be arranged in forefoot region 1010 as well. In some cases, second set of studs 1080 may be arranged in a generally lateral direction on sole 1000.

In some embodiments, plurality of elongated studs 1050 can further include third set of elongated studs 1090, comprising stud 1092, stud 1094, stud 1096 and stud 1098. Third set of studs 1090 may include studs that are arranged around lower periphery 1073 of heel portion 1014.

Although the arrangement of elongated studs 1050 on sole 1000 may be similar to the arrangement of elongated studs of the previous embodiments, it will be understood that in still other embodiments any other arrangement of elongated studs on a sole structure could be used. Furthermore, the specific number of studs, as well as their size, geometry, orientation and relative spacing, could be varied according to the desired traction properties for sole 1000.

Figure 12:
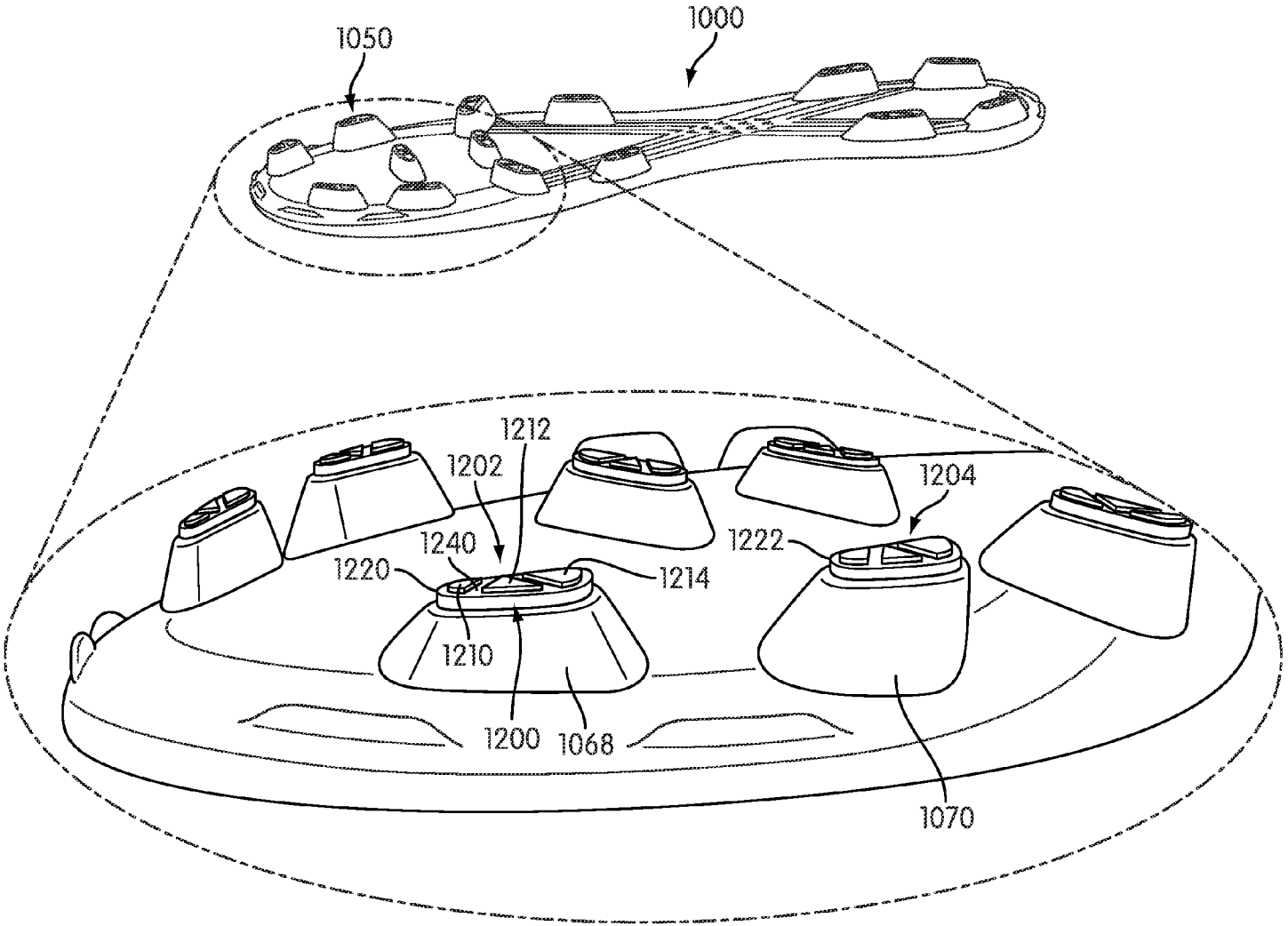
FIG. 12 is an isometric view of an embodiment of a sole structure including an enlarged view of a forefoot region.

As shown in FIG. 12, some embodiments can include elongated studs with provisions for enhancing traction, especially on hard surfaces. In some embodiments, at least some of plurality of elongated studs 1050 can include traction elements 1200 that facilitate enhanced traction under various conditions. As one example, stud 1068 and stud 1070 include first group of traction elements 1202 and second group of traction elements 1204, respectively. First group of traction elements 1202 comprises first traction element 1210, second traction element 1212 and third traction element 1214 that are disposed on tip portion 1220 of stud 1068. In some cases, traction element 1210, traction element 1212 and traction element 1214 all comprise approximately triangular traction elements arranged in an alternating configuration on tip portion 1220. In particular, traction elements 1202 may be separated by spaces 1240. In some cases, second set of traction elements 1204 are similarly arranged on tip portion 1222 of stud 1070.

Although the current embodiment illustrates triangular shapes for traction elements, in other embodiments the geometry of one or more traction elements could vary. Examples of shapes for traction elements include, but are not limited to: rounded shapes, square shapes, rectangular shapes, triangular shapes, polygonal shapes, regular shapes, irregular shapes as well as any other kinds of shapes. Likewise, the relative height of each traction element could vary from one embodiment to another. Furthermore, the relative spacing between traction elements could vary.

This arrangement of traction elements on the tips of one or more elongated studs may help enhance traction on hard surfaces, especially in wet conditions. In some cases, when a user is moving across a wet surface, water could be channeled through spaces 1240 to improve the friction between the elongated studs and the surface.

In different embodiments, traction elements could be optional. For example, in one embodiment, traction elements 1200 may be absent from plurality of elongated studs 1050. In other cases, some of plurality of elongated studs 1050 could include traction elements while others may not include traction elements. Moreover, in some embodiments where no traction elements are present, the tips of plurality of elongated studs 1050 could be configured as substantially smooth. In still other embodiments where no traction elements are present, the tips of plurality of elongated studs 1050 could be substantially textured.

Sole 1000 can include provisions for enhancing stability at the forefoot and/or heel regions. In some cases, sole 1000 may include one or more peripheral studs that help prevent elongated studs from digging too deeply into a ground surface. In one embodiment, sole 1000 can include peripheral studs that are arranged to improve stability while minimizing interference of the peripheral studs with the motion of a user.

Referring now to FIGS. 10 and 11, sole 1000 may include one or more peripheral studs. In some cases, sole 1000 includes plurality of peripheral studs 1100. Plurality of peripheral studs 1100 may comprise at least one stud that extends outwardly from a peripheral side region 1030 of sole 1000. Peripheral side region 1030 may be a region of sole 1000 that extends between bottom surface 1003 of sole 1000 and a top surface (not shown) that is disposed opposite of bottom surface 1003. For example, in one embodiment, plurality of peripheral studs 1100 includes forefoot peripheral studs 1106. In contrast to the embodiments described above with reference to FIGS. 1 through 9, the current embodiments may also incorporate one or more peripheral studs at the heel of sole 1000, in order to enhance stability and prevent elongated studs at the heel from penetrating too deeply into a ground surface. In some cases, plurality of peripheral studs 1100 may also include heel peripheral studs 1108.

Referring to FIG. 11, forefoot peripheral studs 1106 may include peripheral stud 1110 and peripheral stud 1112 that are disposed on lateral side 1018 of peripheral side region 1030. In addition, forefoot peripheral studs 1106 includes peripheral stud 1114, peripheral stud 1116 and peripheral stud 1118, referred to collectively as group of peripheral studs 1119. Group of peripheral studs 1119 may be disposed on medial side 1116 of peripheral side region 1030. In some cases, peripheral studs 1119 may be disposed on toe portion 1011 of sole 1000. In addition, in some cases, forefoot peripheral studs 1106 may include peripheral stud 1117, which is also disposed on medial side 1116.

Heel peripheral studs 1108 can include peripheral stud 1122, peripheral stud 1124 and peripheral stud 1126 that are disposed on rear peripheral region 1032 of sole 1000. In some cases, heel peripheral studs 1108 can be further associate with stud 1130. Stud 1130 may be disposed inwardly of peripheral stud 1122, peripheral stud 1124 and peripheral stud 1126.

Figure 13:
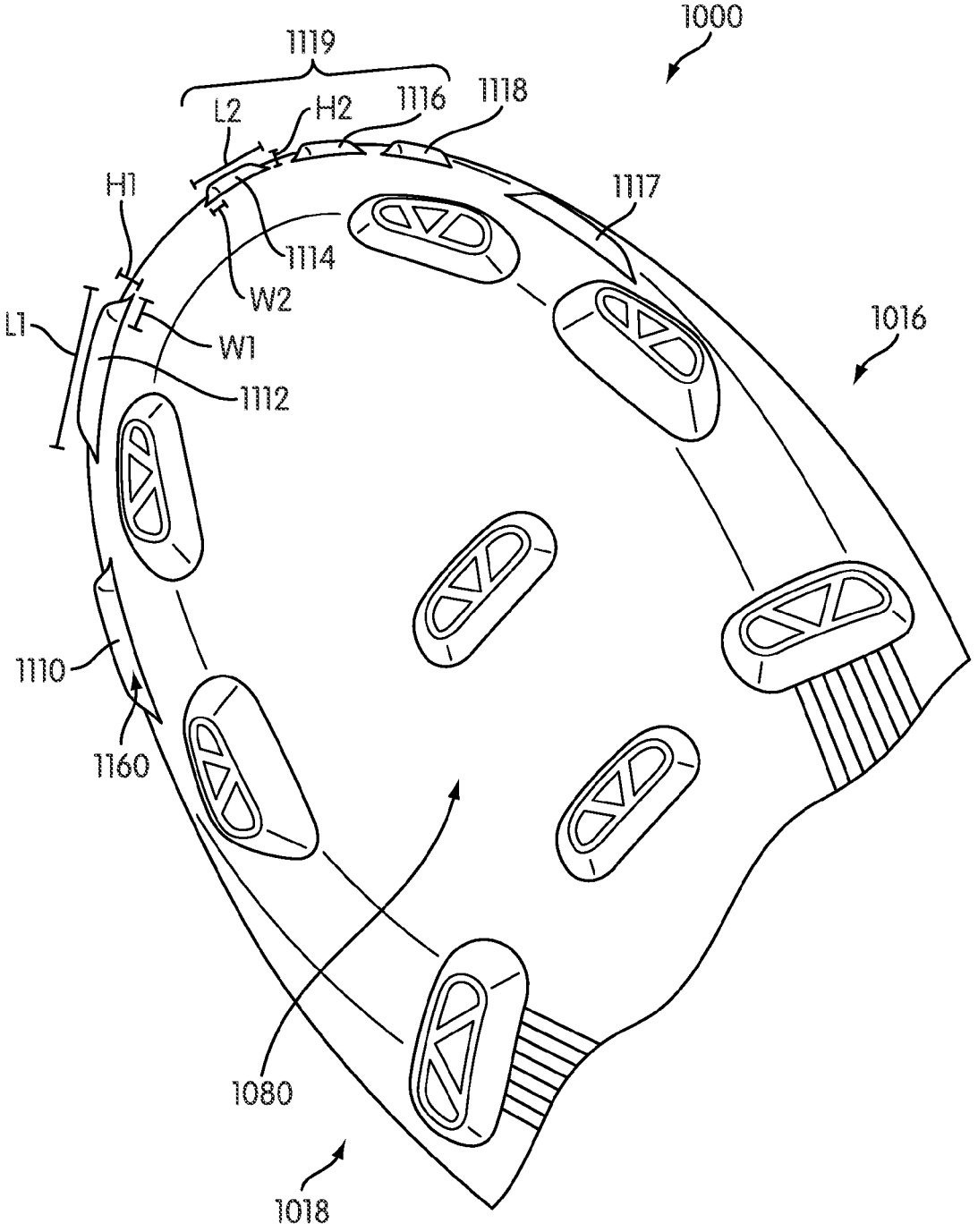
FIG. 13 is an enlarged view of an embodiment of a forefoot region of a sole structure.
Figure 14:
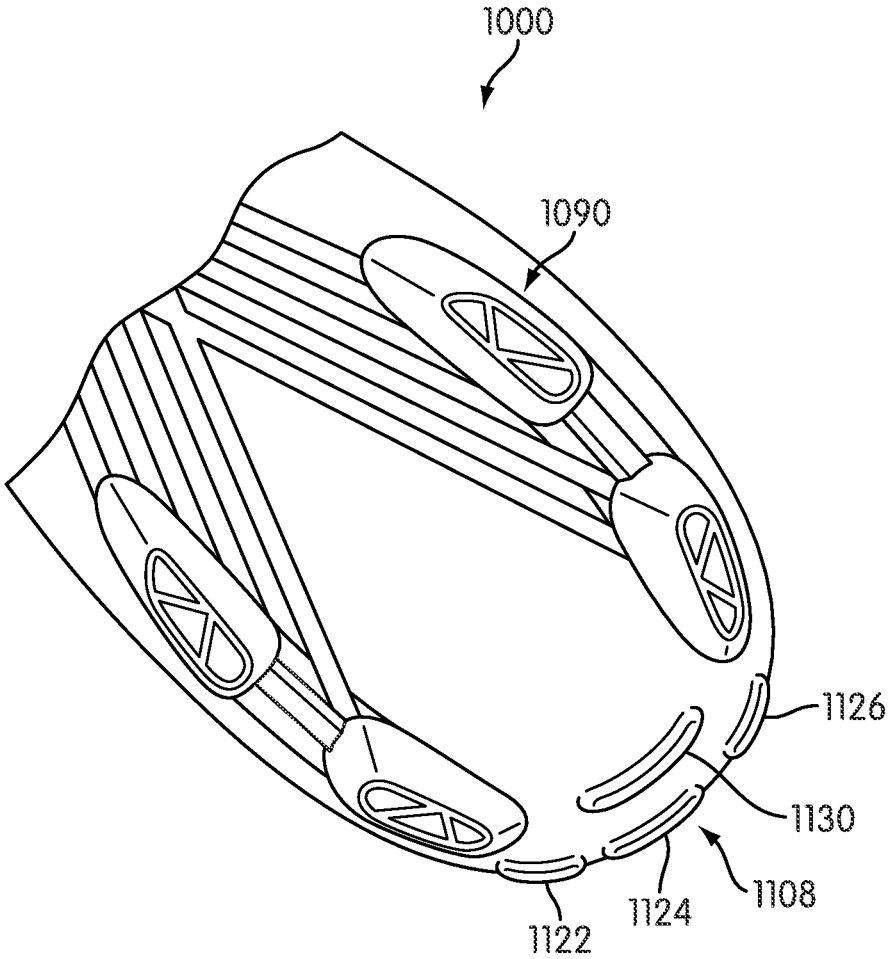
FIG. 14 is an enlarged view of an embodiment of a heel region of a sole structure.

Referring now to FIGS. 13 and 14, the geometry of one or more peripheral studs could vary. As previously discussed, some peripheral studs could have a wedge-like shape. In other cases, however, peripheral studs could have any other shapes including, but not limited to: various types of prism shapes, cuboid shapes, conical shapes, rounded shapes, regular shapes, irregular shapes as well as any other shapes including shapes comprising convex and/or concave portions.

In one embodiment, the generally wedge-like shape of peripheral studs 1100 provides an approximately flat downwardly facing surface that is configured to engage a ground surface and resist penetration of the ground surface at the contact point. For example, peripheral stud 1110 presents surface 1160, which is approximately parallel with lower surface 1080 of sole 1000. Each of the remaining peripheral studs 1100 could also include similar downwardly facing surfaces that confront a ground surface during use and help improve stability.

In some embodiments, one or more peripheral studs could be configured as teeth-like projections that extend down from a peripheral side region of an outsole. In particular, rather than having a generally flat downwardly facing lower surface, the peripheral studs could be configured with rounded lower edges that can contact a ground surface.

Generally, the sizes of one or more peripheral studs could vary. In some cases, the size of a peripheral stud could vary according to its location on sole 1000. For example, in one embodiment, peripheral stud 1110 and peripheral stud 1112, which are disposed on lateral side 1018, may be substantially larger than studs of group of peripheral studs 1119, which are disposed on medial side 1016. For example, peripheral stud 1110 and peripheral stud 1112 may have an approximate length L1 while peripheral stud 1114, peripheral stud 1116 and peripheral stud 1118 may have an approximate length L2. In some cases, length L1 is substantially greater than length L2. In other cases, length L1 could be substantially less than length L2. In still other cases, length L1 could be approximately equal to length L2. Additionally, in some cases, peripheral stud 1110 and peripheral stud 1112 may have an approximate width W1 while peripheral stud 1114, peripheral stud 1116 and peripheral stud 1118 may have an approximate width W2. In some cases, width W1 is substantially greater than width W2. In other cases, width W1 could be substantially less than width W2. In still other cases, width W1 could be approximately equal to width W2. Additionally, in some cases, peripheral stud 1110 and peripheral stud 1112 may have an approximate height H1 while peripheral stud 1114, peripheral stud 1116 and peripheral stud 1118 may have an approximate height H2. In some cases, height H1 is substantially greater than height H2. In other cases, height H1 could be substantially less than height H2. In still other cases, Height H1 could be approximately equal to height H2.

With this arrangement, sole 1000 enhances stability for lateral cuts while minimizing the interference of peripheral studs as a user pushes off from the medial and/or toe of sole 1000. In particular, in some cases, peripheral stud 1110 and peripheral stud 1112 are sized to provide sufficient engagement with a ground surface during lateral cuts or similar maneuvers where the lateral edge of sole 1000 tilts towards a ground surface. However, in situations where a user launches from his or her toes and/or from the medial side, group of peripheral studs 1119 are sized to provide some engagement with a ground surface, but not a degree of engagement that might interfere with a user from rolling forward off the front medial side of the foot.

In some cases, group of peripheral studs 1108 may also be sized to provide some stability while minimizing interference with the desired motion of the user. For example, peripheral stud 1122, peripheral stud 1124 and peripheral stud 1126 may be relatively small peripheral studs that are configured to provide some ground engagement. In particular, in some cases, the sizes of peripheral studs 1108 are large enough so that some ground engagement occurs in situations where a user leans back on his or her heel, but not so large that peripheral studs 1108 significantly engage with the ground during running motions or other typical movements of the foot.

Different embodiments could use different methods for forming peripheral studs. For example, some embodiments may include provisions for forming peripheral studs during a molding process. In particular, in some cases, peripheral studs could be molded studs that are integrally formed with a portion of an outsole at the time of manufacturing.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. An article of footwear comprising:

a sole structure having a bottom surface, a top surface opposite the bottom surface, and a peripheral side region extending between the bottom surface of the sole structure and the top surface of the sole structure, the peripheral side region including an outer medial peripheral edge and an outer lateral peripheral edge;

a first peripheral stud extending from the outer medial peripheral edge of the peripheral side region and including a first surface and a second surface, the first surface and the second surface defining a medial edge that extends in a first direction parallel to the outer medial peripheral edge between a heel region of the sole structure and a forefoot region of the sole structure; and a second peripheral stud extending from the outer lateral peripheral edge of the peripheral side region and including a first surface and a second surface, the first surface of the second peripheral stud and the second surface of the second peripheral stud defining a lateral edge that extends in a second direction parallel to the outer lateral peripheral edge between the heel region and the forefoot region, wherein one of the first surface of the first peripheral stud or the first surface of the second peripheral stud extends from the peripheral side region to the medial edge or the lateral edge, respectively, in a direction approximately parallel to the bottom surface; and wherein one of the second surface of the first peripheral stud or the second surface of the second peripheral stud extends from the peripheral side region towards the bottom surface and to the medial edge or the lateral edge, respectively.

2. The article of footwear according to claim 1, wherein the first peripheral stud is approximately wedge-shaped and wherein the second peripheral stud is approximately wedge-shaped.

3. The article of footwear according to claim 1, wherein the first peripheral stud and the second peripheral stud are integrally formed with the sole structure.

4. The article of footwear according to claim 1, wherein the first peripheral stud is disposed in a toe region of the sole structure.

5. The article of footwear according to claim 1, wherein the first surface of the first peripheral stud is substantially smooth.

6. The article of footwear according to claim 1, wherein the second peripheral stud is located in the forefoot region of the sole structure.

7. An article of footwear, comprising:

a sole structure having a bottom surface and a peripheral side surface that is substantially perpendicular to the bottom surface, the peripheral side surface including an outer medial peripheral edge and an outer lateral peripheral edge;

a first peripheral stud disposed on the outer medial peripheral edge of the peripheral side surface and including a first surface and a second surface that define a medial edge that extends in a first direction parallel to the outer medial peripheral edge between a heel region of the sole structure and a forefoot region of the sole structure; and a second peripheral stud disposed on the outer lateral peripheral edge of the peripheral side surface, the second peripheral stud including a first surface and a second surface that define a lateral edge that extends in a second direction parallel to the outer lateral peripheral edge between the heel region and the forefoot region, wherein one of the first surface of the first peripheral stud or the first surface of the second peripheral stud extends from the peripheral side surface to the medial edge or the lateral edge, respectively, in a direction approximately parallel to the bottom surface, and wherein one of the second surface of the first peripheral stud or the second surface of the second peripheral stud extends from the peripheral side surface towards the bottom surface and to the medial edge or the lateral edge, respectively.

8. The article of footwear according to claim 7, wherein the first peripheral stud has a first size and the second peripheral stud has a second size that is greater than the first size.

9. The article of footwear according to claim 7, wherein (i) the one of the first surface of the first peripheral stud or the first surface of the second peripheral stud and (ii) the one of the second surface of the first peripheral stud or the second surface of the second peripheral stud define an acute angle.

10. The article of footwear according to claim 7, wherein the first peripheral stud has a wedge-like shape.

11. The article of footwear according to claim 7, further comprising a heel peripheral stud set including a third peripheral stud and a fourth peripheral stud, wherein the third peripheral stud and the fourth peripheral stud extend from the peripheral side surface in the heel region.

12. The article of footwear according to claim 11, wherein the third peripheral stud is disposed on a lateral side of the sole structure, and wherein the fourth peripheral stud is disposed on a medial side of the sole structure.

13. The article of footwear according to claim 1, wherein the first peripheral stud has a first size and the second peripheral stud has a second size that is greater than the first size.

14. The article of footwear according to claim 1, wherein (i) the one of the first surface of the first peripheral stud or the first surface of the second peripheral stud and (ii) the one of the second surface of the first peripheral stud or the second surface of the second peripheral stud define an acute angle.

* * * * *